US005297799A

United States Patent [19]

Slater et al.

[11] Patent Number: 5,297,799

[45] Date of Patent: Mar. 29, 1994

[54] DISC FOR CATCH AND THROW GAMES

[76] Inventors: Christopher N. Slater; Paula B. Slater, both of 8 Crestview Dr., San Rafael, Calif. 94903

[21] Appl. No.: 85,648

[22] Filed: Jun. 29, 1993

[51] Int. Cl.[5] ..... A63B 67/06

[52] U.S. Cl. ..... 273/346; 273/412; 273/424; 273/DIG. 30

[58] Field of Search ..... 273/346, 344, 345, 347, 273/412, 424, 425; 446/46

[56] References Cited

U.S. PATENT DOCUMENTS

| | | | |
|---|---|---|---|
| 4,017,076 | 4/1977 | Bai | 273/346 |
| 4,248,010 | 2/1981 | Fox | 273/424 X |
| 4,262,911 | 4/1981 | Opresik | 273/425 X |
| 4,736,955 | 4/1988 | Pollock | 273/346 X |
| 4,819,947 | 4/1989 | Mackey | 273/412 |
| 4,995,617 | 2/1991 | Lee | 273/346 |
| 5,067,727 | 11/1991 | Crompton | 273/346 X |
| 5,080,374 | 1/1992 | Yu et al. | 273/346 |
| 5,085,442 | 2/1992 | Lee | 273/346 |
| 5,123,655 | 6/1992 | Rones | 273/346 |

OTHER PUBLICATIONS

"Grip Disc", Griptoys, Inc. (undated-may or may not constitute prior art).

*Primary Examiner*—William H. Grieb

*Attorney, Agent, or Firm*—Phillips, Moore, Lempio & Finley

[57] ABSTRACT

A throwing disc, adapted for use in a catch and throw game, comprises a disc shaped member that is aerodynamically configured for permitting the disc to be thrown over a substantial distance and received by a catcher's mitt or the like. A set of fasteners, preferably Velcro brand hook fasteners, are formed on the catcher's mitt. A set of Velcro brand loop fasteners are positioned on the disc-shaped member to project substantially above at least one of its upper and lower sides for engaging and releasably interlocking with the fasteners formed on the catcher's mitt. In a preferred embodiment of this invention, the fasteners provided on the disc are dome-shaped.

19 Claims, 3 Drawing Sheets

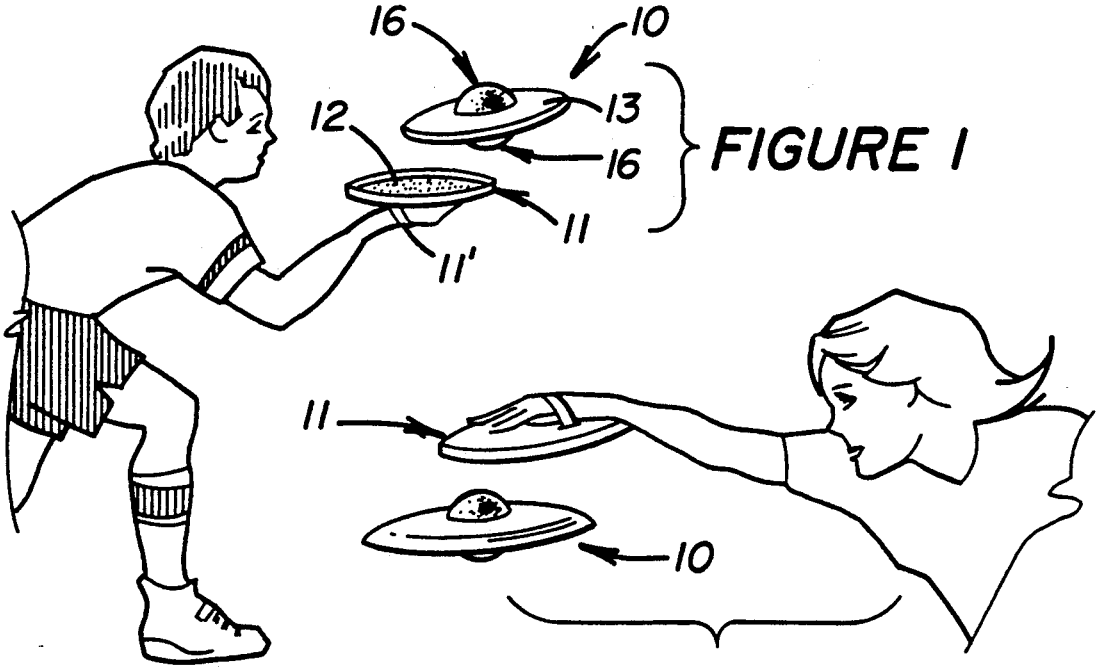
FIGURE 1
FIGURE 2
FIGURE 3
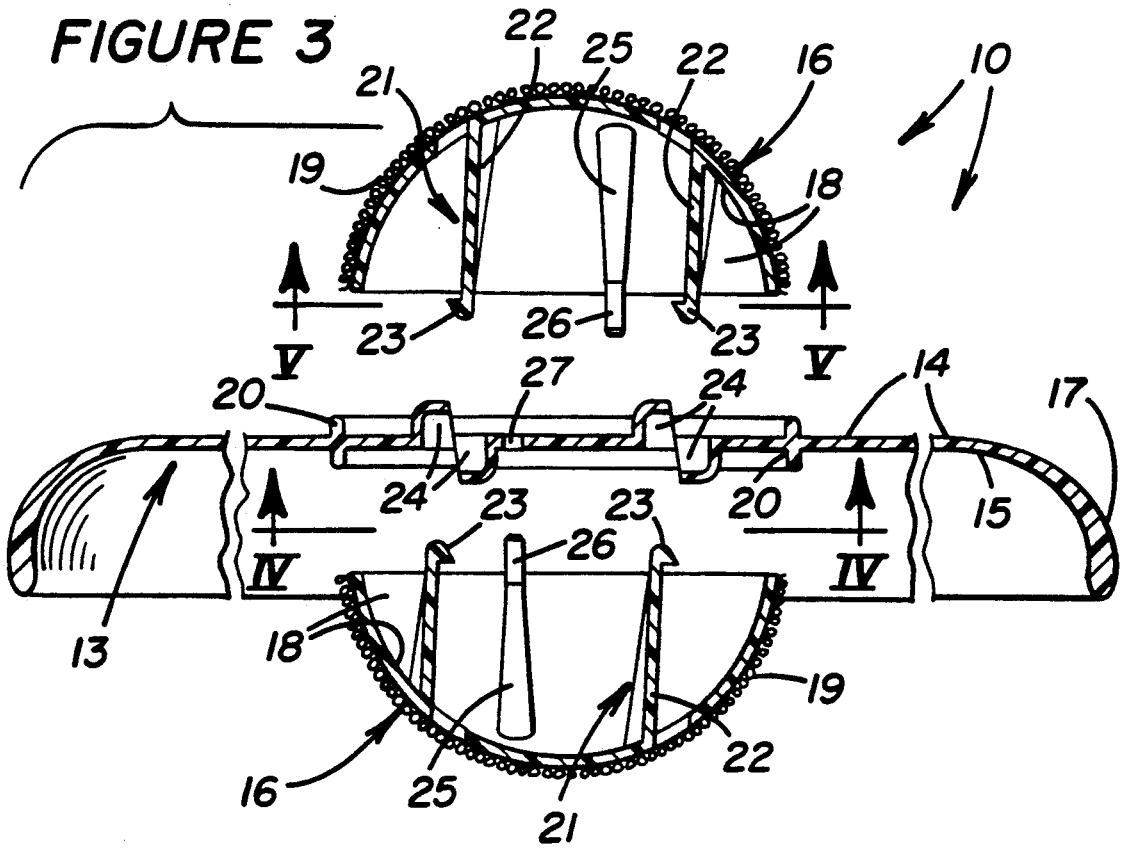

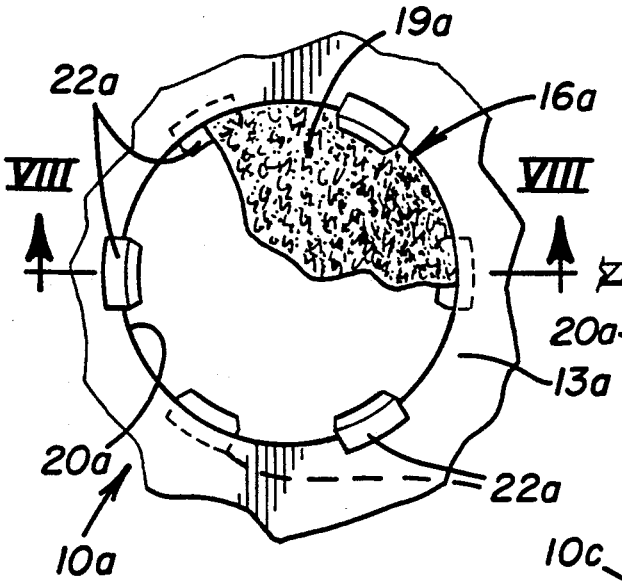
FIGURE 7
FIGURE 8
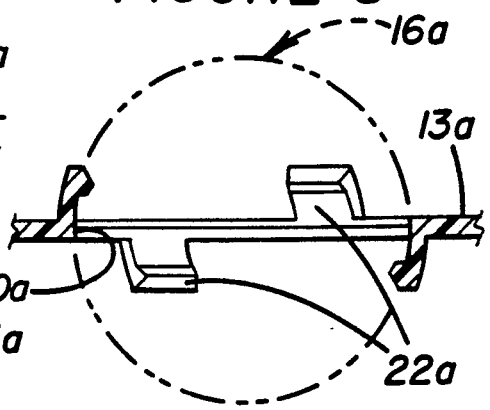
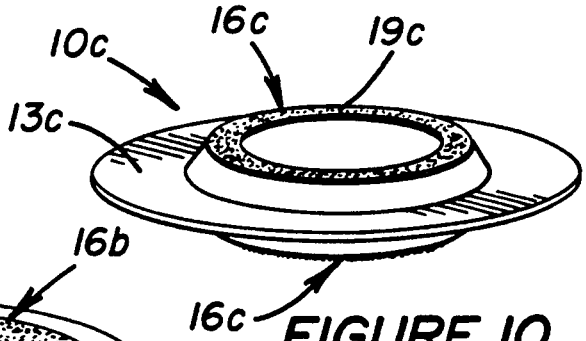
FIGURE 10
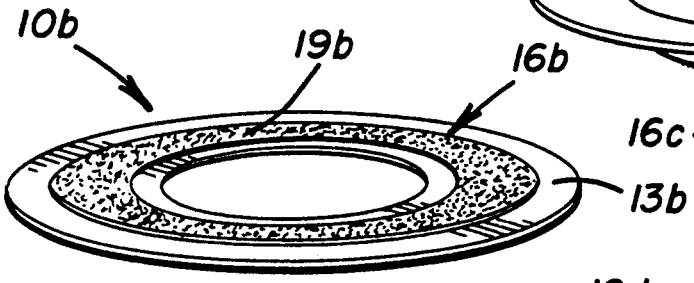
FIGURE 9
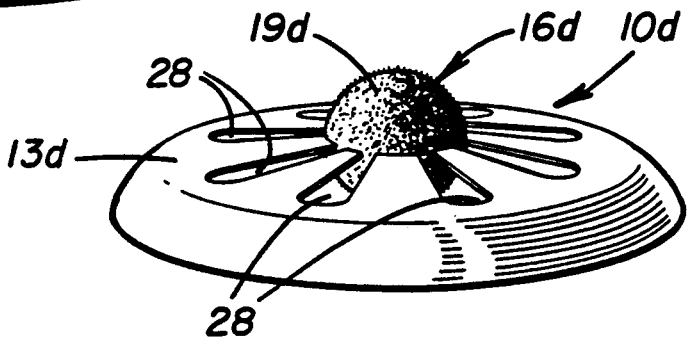
FIGURE 11
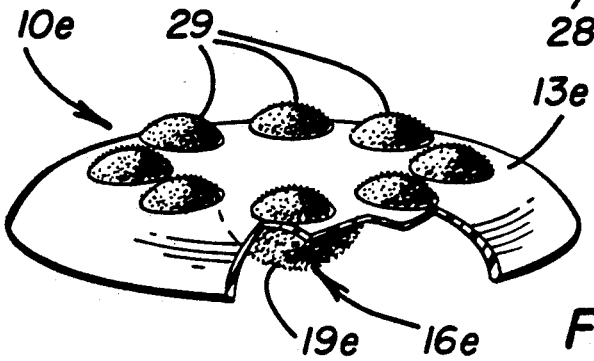
FIGURE 12

DISC FOR CATCH AND THROW GAMES

TECHNICAL FIELD

This invention relates to a disc adapted to be thrown and caught by a catcher's mitt or the like, and more particularly to a throwing disc constructed to releasably attach itself to the mitt when caught thereby.

BACKGROUND ART

Catch and throw games have become very popular in the toy market. For example, U.S. Pat. No. 4,995,617 discloses a game of this type comprising a ball covered with Velcro brand loop fasteners and a catcher's mitt covered with Velcro brand hook fasteners. When the ball impacts on the catcher's mitt, the ball releasably attaches thereto during the course of playing the catch and throw game. Various other types of products are currently sold in the toy market, using variations of such a catch and throw game.

For example, U.S. Pat. No. 5,080,374 discloses a similar ball in the form of a dart that impacts on a paddle and is held thereon until released by a player. U.S. Pat. No. 5,123,655 discloses a game wherein a disc, covered by Velcro brand fasteners, is adapted to be caught by a baton. A similar game involves the use of a disc adapted to be caught by a glove. The Velcro brand fasteners are formed as inserts, positioned flush on a surface of the disc, and is thus especially adapted for use with the glove which also has Velcro brand fasteners thereon.

DISCLOSURE OF INVENTION

An object of this invention is to provide a disc for a catch and throw game that is adapted to be thrown and caught by a wide variety of presently available and widely marketed conventional catcher mitts and paddles.

The disc comprises a disc-shaped member having aerodynamic upper and lower surfaces for permitting the disc to be thrown over a substantial distance and received by a catcher's mitt or paddle. Fastening means, positioned on and projecting substantially above at least one of the upper and lower sides of the disc-shaped member, are adapted to engage and releasably interlock with fastening means on the catcher's mitt to releasably attach the disc to the catcher's mitt when it is caught thereby. In the preferred embodiment of this invention, the fastening means on the disc comprise Velcro brand fasteners, compatible with similar fasteners on the catcher's mitt or paddle.

BRIEF DESCRIPTION OF THE DRAWINGS

Other advantages and objects of this invention will become a apparent from the following description and accompanying drawings wherein:

FIG. 1 illustrates a disc embodiment of this invention being caught at its underside by a catcher's mitt;

FIG. 2 illustrates the catching of the disc at an upper side thereof;

FIG. 3 is an exploded, sectional view of the disc, generally taken in the direction of arrows III—III in FIG. 5;

FIG. 7 is a partial top plan view of a modified disc wherein a ball is releasably locked within a disc-shaped member;

FIG. 8 is a sectional view through the disc, taken in the direction of arrows VIII—VIII in FIG. 7;

FIG. 9 shows a modified disc having a ring secured thereon;

FIG. 10 is a similar modification of the disc, having a raised ring secured thereon;

FIG. 11 is a further modification illustrating a disc having a plurality of circumferentially spaced cutouts formed therethrough; and FIG. 12 is a modification illustrating a disc having a plurality of individual semispherical balls secured on a side thereof.

MODES FOR CARRYING OUT THE INVENTION

Figure 4:
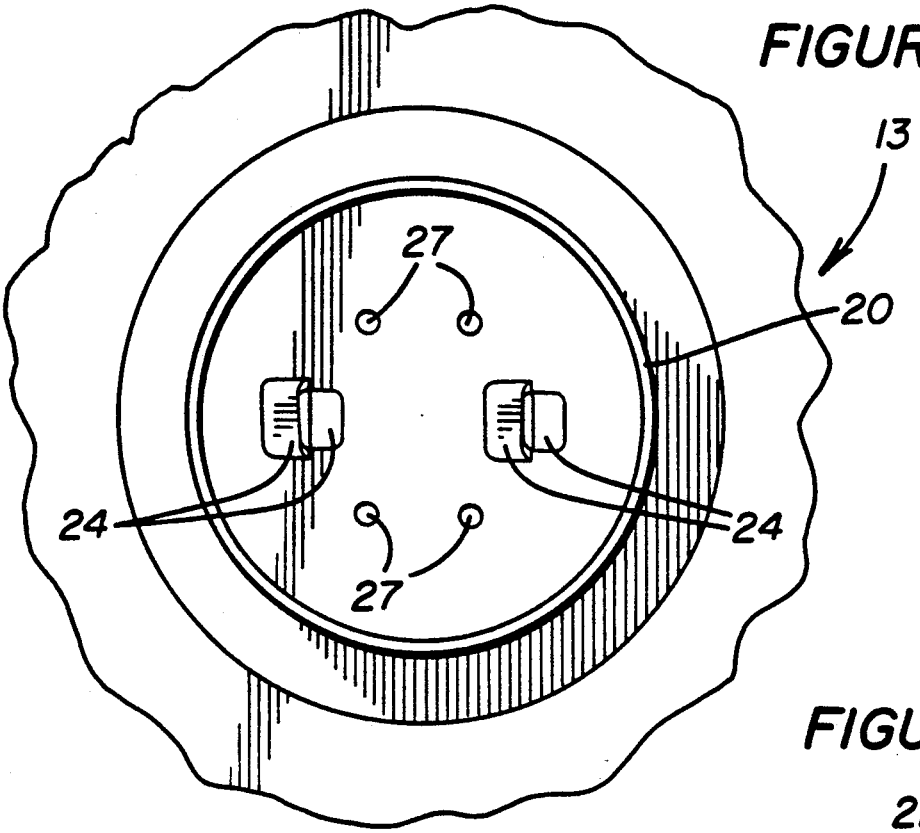
FIG. 4 is an underside view of a disc-shaped member comprising the disc, taken in the direction of arrows IV—IV in FIG. 3.
Figure 5:
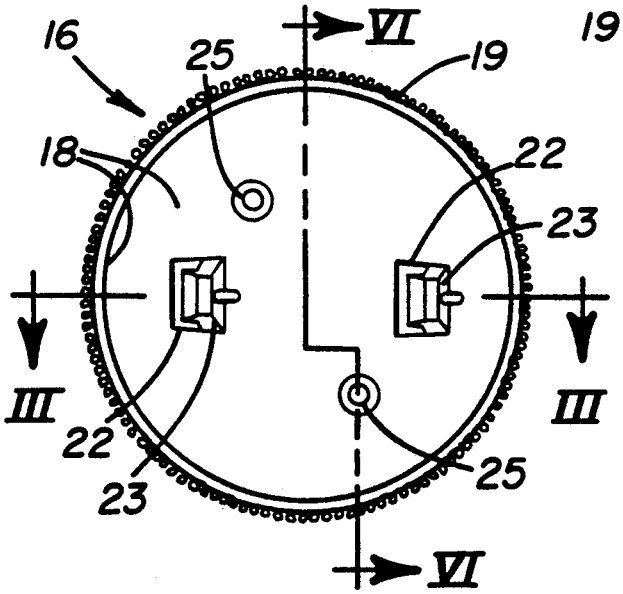
FIG. 5 is a bottom plan view of a dome used in the disc, taken in the direction of arrows V—V in FIG. 3.

FIG. 1 illustrates a toy disc 10 adapted to be thrown and caught by a catcher's mitt 11 having a strap 11' and first fastening means 12 on an exposed face thereof for catching and releasably holding the disc thereon. Disc 10 comprises a disc-shaped member 13 having aerodynamic upper and lower surfaces 14 and 15 (FIG. 3) defined thereon for permitting the disc to be thrown accurately over a substantial distance. In the embodiment illustrated, a dome or semi-spherically shaped second fastening means 16 is centrally disposed by each of the upper and lower sides of member 13.

Each second fastening means 16 is positioned on the member to project substantially above a respective upper or lower side thereof for engaging and releasably interlocking the first and second fastening means together to releasably attach disc 10 to catcher's mitt 11 when the disc caught thereby. In the preferred embodiment of this invention, first fastening means 12 comprise Velcro brand hook fasteners whereas second fastening means 16 of disc 10 comprise Velcro brand loop fasteners. It should be understood that this arrangement could be reversed, i.e., first fastening means 12 would comprise loop fasteners and second fastening means 16 would comprise hook fasteners.

Referring to FIGS. 3–6, disc-shaped member 13 further comprises a circular outer edge 17 that intersects and circumferentially bounds the upper and lower sides of the member. In the embodiment illustrated, member 13 is saucer-shaped with outer edge 17 forming a curved flange. In all of the embodiments described herein, second fastening means 16 or its counterpart is positioned on at least one side of member 13 or its counterpart. The fastening means are each further positioned radially inwardly from the outer edge of a respective member and are commonly positioned to project axially outwardly from the member and its outer circular edge.

In the embodiment illustrated in FIGS. 1–6, a pair of identical second fastening means 16 are positioned at least substantially centrally on member 13 and on opposite sides thereof. Each second fastening means is preferably arcuately shaped and is shown as spherically or dome shaped, e.g., semi-spherical. The outer diameter of disc 13, at outer edge 17, is preferably selected from the approximate range of from 4.0 inches to 12.0 inches, and an outer diameter of each spherically shaped second fastening means 16 is selected from the approximate range of from 1.0 inches to 4.0 inches. More preferably, the outer diameter of the disc closely approximates 8.0 inches and the outer diameter of each dome-shaped second fastening means 16 closely approximates 2.50 inches.

Each second fastening means comprises a rigid dome 18 mounted on a respective side of member 13 and loop fasteners 19 totally covering and adhesively secured on exterior surfaces of the dome. Member 13 and domes 18 can be formed from a suitable and moldable plastic material, such as a high impact polystyrene. The member and domes are suitably finished to be free of any visible imperfections, i.e., to a standard mold finish.

As shown in FIGS. 3 and 4, an annular flange 20 is integrally molded on each of the upper and lower sides of member 13 for closely surrounding a respective one of domes 18, when assembled, to prevent lateral displacement of the domes relative to the member. The domes are suitably secured on the member by a plurality of hook means 21 secured within each of the domes. Each of the hook means comprises a prong 22 having its proximal end integrally molded within dome 18 and a hook 23 suitably formed on a distal end of the prong.

Figure 6:
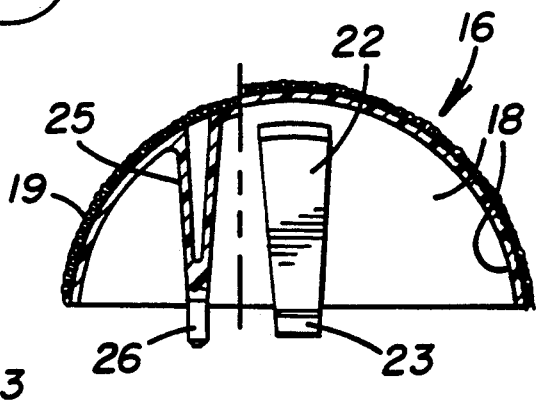
FIG. 6 is a sectional view through the dome, taken in the direction of arrow VI—VI in FIG. 5.
Figure 6A:
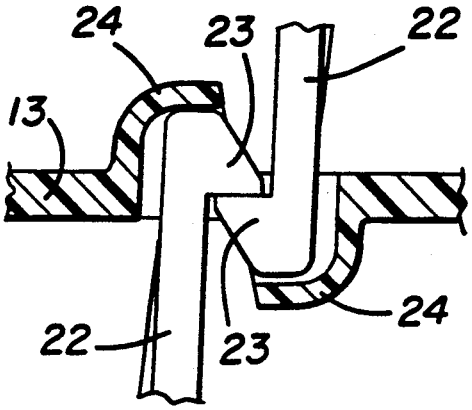
FIG. 6A is an enlarged sectional view illustrating the interengagement of a pair of hooks, used for locking a pair of the domes together on the member.

FIG. 6*a* is a fragmentary view illustrating the interlocking positions of a pair of opposed hooks 23 when domes 18 are secured in place on member 13. In particular, a pair of diametrically opposed positioning cups 24 are formed integrally on member 13 to receive and guide hooks 23 into their interlocking positions shown in FIGS. 6A. In the embodiment illustrated, two pairs of such interlocking hooks are utilized to fully secure the domes on member 13.

In addition, FIGS. 3–6 illustrate cooperating locating means for precisely locating the domes on the member for permitting hook means 21 to engage and lock the domes together on member 13. In the embodiment illustrated, such locating means comprises a second set of prongs 25 each having its proximal end integrally secured within a respective dome 18 and a tapered distal end 26. The locating means further comprises a locating hole 27 adapted to receive a tapered end 26 of a respective prong 25. If so desired, a suitable adhesive could be utilized to further secure the domes on member 13.

FIGS. 7–12 illustrate additional embodiments of this invention wherein identical numerals depict constructions and arrangements generally corresponding to those depicted by identical numerals in FIGS. 1–6.

FIGS. 7 and 8 partially illustrate a modified disc 10*a* comprising a disc-shaped member 13*a* having a fastening means 16*a* releasably secured thereon. The fastening means may comprise a spherical plastic member or a standard tennis ball covered with Velcro brand loop fasteners. The ball is releasably secured within a centrally disposed circular opening 20*a*, formed through member 13*a*, by a plurality of circumferentially disposed and spaced locking means shown in the form of resilient snap-action type locking lugs 22*a*.

FIG. 9 illustrates a modified embodiment wherein a disc 10*b* comprises fastening means 16*b* in the form of a ring, centrally disposed on at least one of the upper and lower sides of a disc-shaped member 13*b* and hook or loop fasteners 19*b* exteriorly covering the ring.

FIG. 10 illustrates a similar modified embodiment wherein a disc 10*c* comprises a raised ring 16*c* disposed centrally on a member 13*c* and covered with Velcro brand loop fasteners 19*c* to provide the above-discussed fastening means desiderata.

FIG. 11 illustrates a modified disc 10*d* comprising a member 13*d* having a plurality of circumferentially disposed and radially extending slots 28 formed through the member. The slots extend radially outwardly from a centrally disposed and dome-shaped fastening means 16*d*, which can be secured on one or both sides of the disc.

FIG. 12 illustrates a modified disc 10*e* comprises a disc-shaped member 13*e* having a dome-shaped second fastening means 16*e* disposed centrally on one side thereof and covered with loop fasteners 19*e*. Another fastening means is provided on the opposite side of member 13*e* and comprises a plurality of circumferentially spaced individual and smaller dome-shaped fastening means 29, each covered with loop fasteners.

We claim:

1. A disk adapted to be thrown and caught by a catcher's mitt having first fastening means for catching and releasably holding said disc thereon, said disc comprising a disc-shaped member having upper and lower surface means defined on upper and lower sides thereof, respectively, for permitting said disc to be thrown over a substantial distance and received by said catcher's mitt, and arcuately shaped second fastening means positioned at least substantially centrally on said member and further positioned on and projecting substantially above at least one of the upper and lower sides of said member for engaging and releasably interlocking with said first fastening means to releasably attach said disc to said catcher's mitt when it is caught thereby, said member further comprising an annular outer edge intersecting and circumferentially bounding said upper and lower sides and wherein said second fastening means is positioned radially inwardly from said outer edge.

2. The disc of claim 1 wherein said second fastening means comprises a series of hook or loop fasteners adapted to releasably interlock with a series of mating hook or loop fasteners on said catcher's mitt.

3. The disc of claim 2 wherein said second fastening means is a series of loop fasteners adapted to releasably interlock with a series of mating hook fasteners on said catcher'mitt.

4. The disc of claim 3 further comprising a catcher's mitt comprising a rigid holder, a hand-receiving strap secured to a first side of said holder and a series of hook fasteners on a second side of said holder adapted to engage and releasably interlock with the loop fasteners on said disc to releasably attach said disc to said catcher's mitt when it is caught thereby.

5. The disc of claim 1 wherein said second fastening means is spherically shaped.

6. The disc of claim 5 further comprising a plurality of circumferentially disposed slots formed through said member to extend radially outwardly from said second fastening means.

7. The disc of claim 5 wherein said spherically shaped second fastening means is secured on the lower side of said member and a plurality of circumferentially spaced third fastening means are secured on the upper side of said member, each of said second and third fastening means including hook or loop fasteners covering the exterior thereof.

8. The disc of claim 5 wherein an outer diameter of said disc at said outer edge is selected from the approximate range of from 4.0 inches to 12.0 inches, and an outer diameter of said spherically shaped second fastening means is selected from the approximate range of from 1.0 inches to 4.0 inches.

9. The disc of claim 8 wherein the outer diameter of said disc closely approximates 8.0 inches, and the diameter of said second fastening means approximates 2.50 inches.

10. The disc of claim 1 wherein said second fastening means projects outwardly from only one of the upper and lower sides of said disc.

11. The disc of claim 1 wherein said second fastening means projects outwardly from each of the upper and lower sides of said disc.

12. The disc of claim 11 wherein said second fastening means comprises a pair of spherically shaped and rigid domes mounted on the upper and lower sides of said member and hook or loop fasteners covering exterior surfaces of each of said domes.

13. The disc of claim 12 further comprising hook means secured within each of said domes and projecting into said member for engaging and locking said hook means together to hold said domes on said member.

14. The disc of claim 13 further comprising cooperating locating means formed on said domes and in said member for precisely locating said domes on said member for permitting said hook means to engage and lock together.

15. The disc of claim 12 further comprising an annular flange means on each of the upper and lower sides of said member for closely surrounding a respective one of said domes to prevent lateral displacement of said domes relative to said member.

16. The disc of claim 1 wherein said member defines a circular opening formed centrally therethrough and a plurality of ball locking means disposed circumferentially about said opening and said second fastening means comprises a ball and hook or loop fasteners exteriorly covering said ball, said ball disposed in said opening and releasably locked therein by said locking means.

17. The disc of claim 1 wherein said second fastening means comprises a ring centrally disposed on at least one of the upper and lower sides of said member and hook or loop fasteners exteriorly covering said ring.

18. A disk adapted to be thrown and caught by a catcher's mitt having first fastening means for catching and releasably holding said disc thereon, said disc comprising a disc-shaped member having upper and lower surface means defined on upper and lower sides thereof, respectively, for permitting said disc to be thrown over a substantial distance and received by said catcher's mitt, and second fastening means positioned on and projecting substantially above and outwardly from each of the upper and lower sides of said member for engaging and releasably interlocking with said first fastening means to releasably attach said disc to said catcher's mitt when it is caught thereby, said member further comprising an annular outer edge intersecting and circumferentially bounding said upper and lower sides and wherein said second fastening means is positioned radially inwardly from said outer edge, said second fastening means comprising a pair of spherically shaped and rigid domes mounted on the upper and lower sides of said member and hook or loop fasteners covering exterior surfaces of each of said domes.

19. A disk adapted to be thrown and caught by a catcher's mitt having first fastening means for catching and releasably holding said disc thereon, said disc comprising a disc-shaped member having upper and lower surface means defined on upper and lower sides thereof, respectively, for permitting said disc to be thrown over a substantial distance and received by said catcher's mitt, and second fastening means positioned on and projecting substantially above at least one of the upper and lower sides of said member for engaging and releasably interlocking with said first fastening means to releasably attach said disc to said catcher's mitt when it is caught thereby, said member defining a circular opening formed centrally therethrough and a plurality of ball locking means disposed circumferentially about said opening and wherein said second fastening means comprises a ball and hook or loop fasteners exteriorly covering said ball, said ball disposed in said opening and releasably locked therein by said locking means.

* * * * *